United States Patent [19]

Tanaka

[11] 4,207,055

[45] Jun. 10, 1980

[54] CIGARETTE LIGHTER WITH SYNERGISTIC IGNITING MEANS

[75] Inventor: Noboru Tanaka, Tokyo, Japan

[73] Assignee: Tokyo Pipe Co., Ltd., Tokyo, Japan

[21] Appl. No.: 857,245

[22] Filed: Dec. 5, 1977

[30] Foreign Application Priority Data

Feb. 1, 1977 [JP] Japan ..... 52/9966
Feb. 2, 1977 [JP] Japan ..... 52/10547

[51] Int. Cl.[2] ..... F23Q 2/16

[52] U.S. Cl. ..... 431/258; 431/256; 431/268

[58] Field of Search ..... 431/254, 256, 7, 11, 431/262, 268, 326, 258

[56] References Cited

U.S. PATENT DOCUMENTS

| | | | |
|---|---|---|---|
| 1,899,008 | 2/1933 | Berthold | 431/268 |
| 2,023,400 | 12/1935 | Andrews et al. | 431/268 |
| 2,866,924 | 12/1958 | Delpidio | 431/258 |
| 2,999,534 | 9/1961 | Wagner | 431/262 |
| 3,024,836 | 3/1962 | Bello | 431/268 |
| 3,044,284 | 7/1962 | Kratzenberger | 431/268 |
| 3,057,400 | 10/1962 | Wagner | 431/268 |
| 3,299,675 | 1/1967 | Laffitte et al. | 431/268 |
| 3,304,801 | 2/1967 | Sakita et al. | 431/258 |
| 3,490,878 | 1/1970 | Russell | 431/268 |
| 3,533,718 | 10/1970 | Shuto | 431/254 |

FOREIGN PATENT DOCUMENTS

| | | | |
|---|---|---|---|
| 2614597 | 10/1977 | Fed. Rep. of Germany | 431/268 |
| 599506 | 5/1978 | Fed. Rep. of Germany | 431/254 |

*Primary Examiner*—Charles J. Myhre
*Assistant Examiner*—Jeffrey L. Yates
*Attorney, Agent, or Firm*—Eyre, Mann, Lucas & Just

[57] ABSTRACT

A cigarette lighter employing a combustible gas uses electric means for heating the combustible gas toward its flash point. The electric means is aided by catalytic or thermo-electric means to reduce the power supplied by a self-contained battery. In one embodiment, the combustible gas contains a component which reacts with a catalyst to provide an additional heat increment to the gas in order to reduce the amount of electricity required. In other embodiments, a thermo-electric generator, heated by the flame of the lighter, generates electricity which recharges a rechargeable battery.

5 Claims, 12 Drawing Figures

FIG. 1
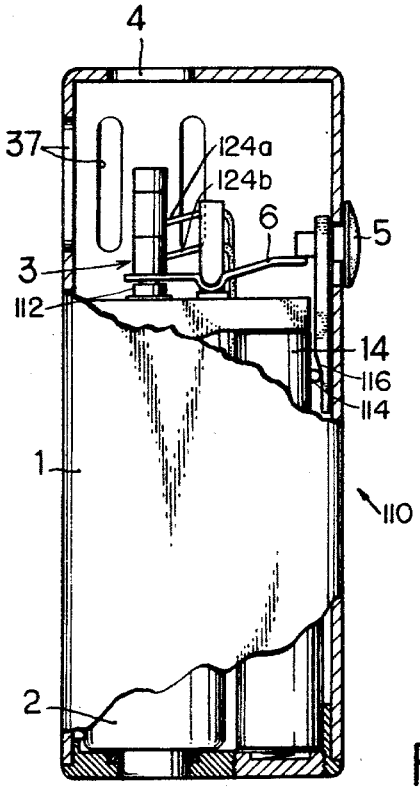
FIG. 2
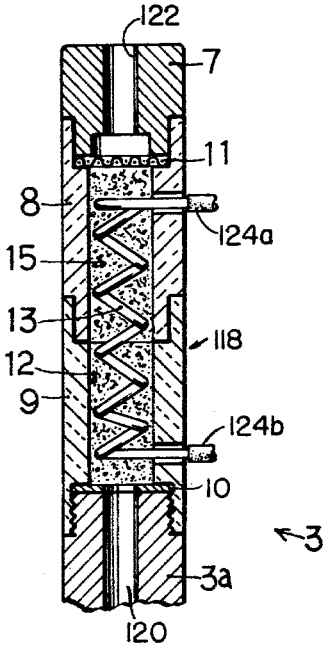
FIG. 5
FIG. 4
FIG. 3
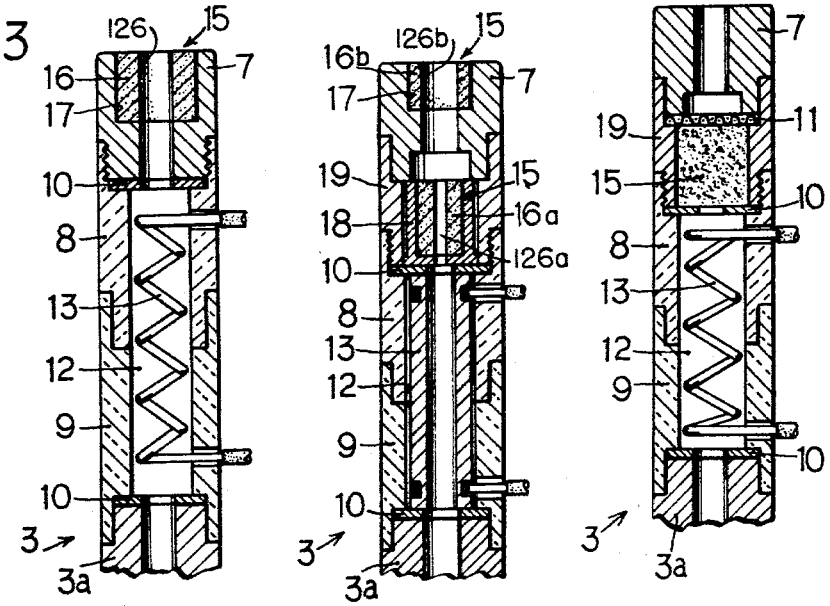

CIGARETTE LIGHTER WITH SYNERGISTIC IGNITING MEANS

BACKGROUND OF THE INVENTION

The prior art discloses pocket lighters in which the flame is kindled by electric spark discharge or heated filament as well as sparking type flints. In addition, lighters are disclosed which use self-combustible gas which spontaneously ignites on contact with the atmosphere and also catalytic materials in whose presence components in a fuel gas react to elevate the gas to the flash point.

The catalytic and self-combustible gas types are desireable from the standpoint that only a single consumable material, namely the fuel, must be replaced. Unfortunately, the self-combustible gas is difficult to safely contain and handle. Lighters using it must therefore be made with greater precision and cost than is consistent with mass market goals. The catalytic types suffer from the fact that the known chemical substances suitable for catalytic lighters do not heat instantly to ignition temperature, but instead they heat quite slowly during the early stages of reaction. As the gas and catalyst temperatures become elevated, the reaction speeds up and rapidly reaches the flash point of the gas. During the heating period, the fuel passing over the catalyst is dissipated uselessly in the atmosphere. This delay is annoying to the user.

Furthermore, the achievement of catalytic reactions with reasonable efficiency required a separate housing for the catalyst and a complicated structure for proportioning gas and air. These increase manufacturing precision and cost.

Electrically ignited lighters have the drawbacks of requiring a battery and that the generation of the required kindling temperature by spark or resistance heating consumes such a great amount of electric power per operation that battery life is necessarily limited. A user depending on his lighter can easily become annoyed when the battery unexpectedly fails to provide sufficient power to ignite the fuel.

SUMMARY OF THE INVENTION

The present disclosure teaches a lighter in which a fuel gas supplied from an integral fuel tank to a nozzle is electrically heated toward the flash point either by resistance heating or high voltage sparking. The lighter contains an electric energy source to produce at least part of the energy required to ignite the gas. An auxiliary energy source reduces the electric energy which must be used.

In a first embodiment, the fuel gas, suitably butane or propane, contains an admixture of a substance, for example methanol, which is capable of exothermic reaction in the presence of a catalyst. The fuel gas mixture is passed through an electric resistance heating chamber containing an electric resistance element heated by power from a battery where the gas temperature is elevated to a temperature below the flash point of the fuel gas but within the temperature range in which the exothermic catalytic reaction is very rapid. The heated gas is then passed over a catalyst material such as a peroxide in a glass or asbestos filler which promotes a rapid temperature rise to the flash point.

In a second embodiment of the invention, a sample of the gas is passed over the legs of a plurality of thermocouples and then through a quantity of catalyst. The thermocouples may be made of iron-Constantine, copper-Constantine or other materials now known or to become known in the art. The thermocouple junctions are thermally connected to the catalyst. The ends of the thermocouple legs are electrically connected together. Thus, any electricity generated by the thermocouples is dissipated in Joule heating of the legs. Initially, the gas reaching the catalyst begins slowly elevating the temperature of the catalyst. The heat is the catalyst causes the thermocouples to generate electricity. The thermoelectric electricity thus generated is dissipated as heat in the legs of the thermocouples. The sample of gas flowing over the thermocouple is heated by contact with the heated legs. The catalytic reaction is speeded up by the elevated temperature of the arriving gas. This further elevates the temperature of the catalyst and results in the generation of greater thermoelectric electricity and further elevates the temperature of the thermocouple legs. This synergistic process continues until the gas sample emerging from the catalyst reaches the flash point. The ignited gas sample then ignites the main jet of gas flowing from a nozzle.

In a third embodiment of the invention, fuel gas ignition is achieved by spark or resistance heating from a rechargeable battery. A thermoelectric generator, exposed to the heat of the flame generates electricity which is then fed back into, and recharges, the rechargeable battery. Recharging continues after the flame is extinguished until the thermoelectric generator cools down to approximately heat-sink temperature. In this way a physically small battery having relatively limited storage capacity is satisfactory. The synergistic process thus uses electricity stored in a battery to kindle a flame, and then uses the heat of the flame to recharge the battery.

In a fourth embodiment of the invention, a sample of the fuel gas is passed over a catalyst en route to the nozzle. A plurality of thermocouples are thermally connected to the catalyst. The electric output of the thermocouples are connected in series and used to recharge a rechargeable battery. The battery provides spark or resistance heat sufficient to kindle the flame and is then recharged by the thermoelectric energy derived from the catalytically heated catalyst material.

BRIEF DESCRIPTION OF THE DRAWINGS

FIG. 1 shows a side elevation view, partially in section, of a first embodiment of the invention.

FIG. 2 shows an enlarged longitudinal cross-sectional view of the nozzle of the lighter of FIG. 1.

FIGS. 3–5 show the respective enlarged longitudinal cross-sectional views of modified nozzle parts which may be substituted for the nozzle shown in FIG. 2.

CROSS REFERENCE TO RELATED APPLICATIONS

Figure 6:
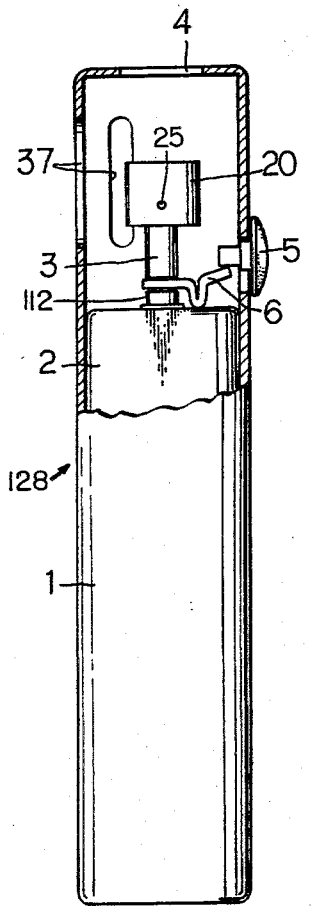
FIG. 6 shows a side elevation, partially in section, of a second embodiment of the invention.

U.S. patent application, Ser. No. 828,636, has been filed on Aug. 29, 1977 for a cigarette lighter. The assignee of this application is the same as the assignee of the present invention. The inventive entities are different.

DETAILED DESCRIPTION OF THE PREFERRED EMBODIMENT

Referring now to FIG. 1, a first embodiment of the invention is shown generally at 110. A case 1 contains a fuel tank 2, adapted to feed gaseous fuel to a nozzle 3. A fuel valve 112 controls the supply of fuel from the tank 2 to the nozzle 3. A lever 6 engages the nozzle 3 at its one end and is connected to an operating button 5 at its second end. The operating button 5 is accessible for manipulation from the exterior of the case. Moving the operating button 5 downward, causes the lever 6 to lift the nozzle 3 which, in turn opens the fuel valve 112 and causes fuel to be supplied to the nozzle. A flame hole 4 in the top of the case 11 aligned with the nozzle 3 allows the issuance of the flame of the lighter. Air holes 37 admit combustion air into the case 1 for mixture with the emerging gas as is well known in the art.

A battery 14 is located in the case 1. An electric switch 114 faces a ramp-type switch actuator 116 attached to, and moveable with, the operating button 5.

Referring now to FIG. 2, a lower tube 3*a* having an axial passage 120 is concentrically connected to an insulated tube 118 made up of a mating lower section 9 and an upper section 8. The insulated tube 118 defines a heating chamber 12 having a diameter greater than the axial passage 120. An insulating disc having an axial bore with a diameter substantially matching the diameter of the axial passage 120 is concentrically located at the junction of the lower tube 3*a* and the lower section 9. A nozzle tip, 7 having an axial passage 122 of smaller diameter than the heating chamber, is concentrically affixed at the top of the upper section 8. An insulating disc 10 (see FIGS. 3–7), or a wire screen or foraminous plate 11 is located at the junction of the nozzle tip 7 and the upper section 8.

A porous body of catalyst material 15 substantially fills the heating chamber 12. An electric resistance heating element 13 suitably in a helical coil is embedded within the catalyst material 15. Electrical leads 124*a*, 124*b* project from the nozzle 3 and are connected by well known means, not explicitly shown, to the battery 14 and electric switch 114.

When the operating button 5 is moved downward, fuel gas containing a component capable of exothermic reaction in the presence of the catalyst passes through axial passage 120 and through the porous body of catalyst material 15, finally emerging through axial passage 122 to the atmosphere. The operating button 5 also moves ramp type switch actuator 116 downward thereby turning on electric switch 114. Electric switch 114 supplies battery power to the heating element 13 simultaneously with the fuel gas flow. The heating element 13 begins heating the gas flowing past it. Simultaneously, the fuel gas is heated by catalytic reaction in the presence of the catalytic material 15. The two processes go on together with efficiency rapidly increasing with time, since the effectiveness of the catalytic reaction accelerates rapidly with increasing temperature. Heat loss from the heating chamber 12 is minimized by the insulating material from which the insulating disc 10 and the upper and lower sections 8, 9 are made. The fuel gas exiting via axial passage 122 is rapidly elevated to the flash point at which time the heated emerging gas ignites on contact with the air. Provision may be made in the coupling of operating button 5 to electric switch 114 for a starting position in which electric power is applied to the heating element 13 until the flame is ignited and then a running position in which the gas flow is continued to sustain the flame but the electricity to the heating element 13 is cut off.

FIGS. 3–5 show alternative ways of achieving gas ignition by combining electric preheating with catalytic reaction to ignite a fuel gas. By removing the catalyst material 15 from the heating chamber 12, its replacement is simplified. In FIG. 3, the heating element 13 occupies the heating chamber 12. The catalyst material 15 is formed as an annular slug 16 having an axial passage 126 fitting into a counterbore 17 in the nozzle tip 7. The heating element preheats the fuel gas passing through the heating chamber 12 before it reaches the catalyst material 15. Upon reaching the catalyst material 15, the preheated fuel gas is further heated by the catalyst material 15 and soon bursts into flame.

The embodiment shown in FIG. 4 has a cylindrical tube-type heating element 13 of a type well-known in the art and has its catalyst material 15 separated into lower and upper annular slugs 16*a*, 16*b*. The axial passage 126 in the lower annular slug 16*a* is of smaller diameter than the axial passage 126*b* in upper annular slug 16*b*.

FIG. 5 illustrates another possible combination where heating element 13 occupies the upstream portion of the heating chamber 12 and a porous body of catalyst material 15 occupies the downstream portion. In this embodiment the fuel gas is preheated by passing over the heating element 13 and further heated to ignition temperature by passage through the interstices of the porous catalyst material 15.

Turning now to the second embodiment of the invention shown in FIG. 6 generally at 128. A case 1 contains a fuel tank 2, a nozzle 3, lever 6, operating button 5, and fuel valve 112, all having analogous functions to the first embodiment previously described.

A thermal reaction body 20 is concentrically affixed to the stem 3. Referring to the detailed sectional view in FIG. 7, the thermal reaction body 20 comprises a cup B having an open top and a metallic foraminous plate 23 dividing the cup B into a lower region containing porous material 22 and an upper thermal reaction region A. Transverse openings 24 admit a portion of the fuel gas in the nozzle 3 to pass outward into the porous material 22. The porous material 22 diffuses the gas over its cross-sectional area and allows it to pass at low velocity through the openings in the foraminous plate 23.

Figure 7:
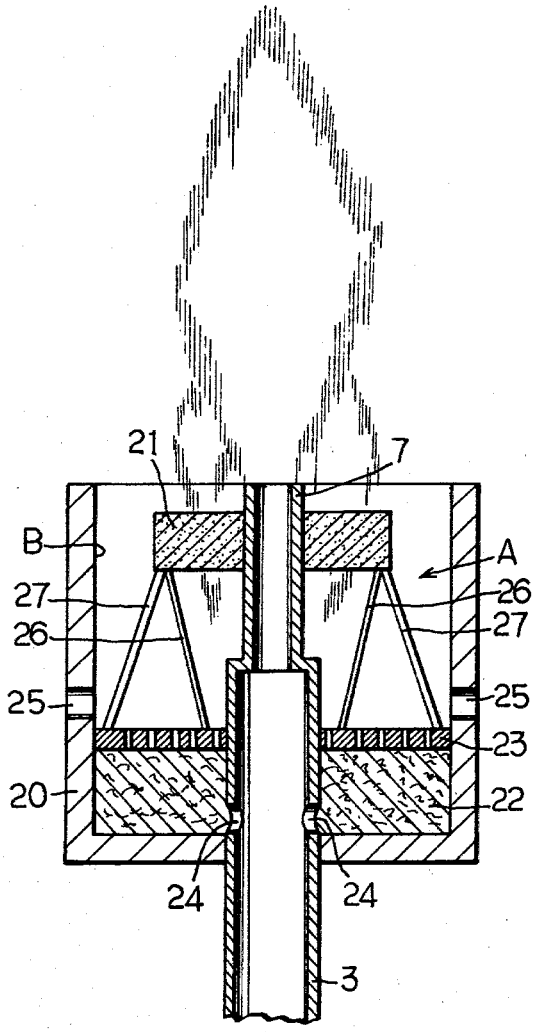
FIG. 7 shows an enlarged longitudinal cross-sectional view of the nozzle of the lighter of FIG. 6.

A body of catalyst material 21 is concentrically affixed to the nozzle tip 7 adjacent the gas exit. A plurality of thermocouple wire pairs 26, 27 have their junctions thermally connected to the catalyst material 21. The other ends of the thermocouple wire pairs 26, 27 are connected to the foraminous plate 23. As is well known, a thermocouple generates a voltage at its heated junction which is related to the temperature difference between its heated and cooled junctions. The cooled junctions in FIG. 7 are represented by the connection of the thermocouple wires 26, 27 to the foraminous plate 23. A plurality of air inlet ports 25 admit air into the thermal reaction region A.

When the flow of fuel is initiated, the catalyst material 21 and the foraminous plate 23 are both at substantially the same temperature. The catalyst material 21 begins to heat as a result of contact with the fuel gas. The heating of the catalyst material 21 causes the thermally connected thermocouples 26, 27 to begin producing electricity. Since the outboard ends of the thermocouples 26, 27 are electrically short-circuited by connection to the foraminous plate 23, the electricity generated by the thermocouples 26, 27 is dissipated by resistive heating of the wires 26, 27. The fuel gas, now passing over the heated thermocouple wires 26, 27 is itself heated before it reaches the catalyst material 21. The catalytic reaction rapidly becomes more efficient as the arriving gas becomes warmer and warmer thus accelerating the heating of the catalyst material 21. When the ignition temperature of the fuel gas is attained, the gas passing over the catalyst material 21 is ignited. This, in turn, ignites the fuel gas emerging from the nozzle tip 7.

Figure 10:
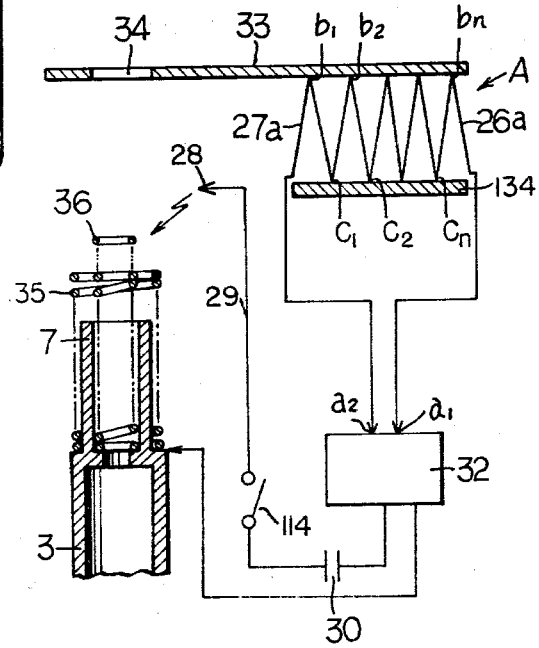
FIG. 10 shows a schematic diagram of the lighter of FIG. 8.
Figure 11:
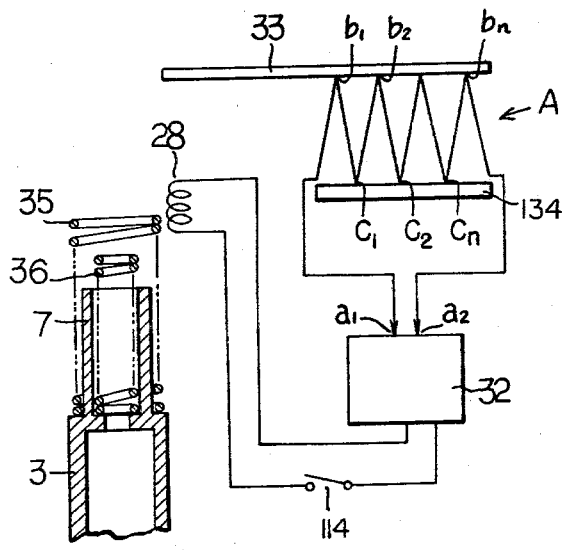
FIG. 11 shows a schematic diagram containing modifications of the circuit shown in FIG. 10.

The third embodiment of the invention, shown in FIG. 8 at 130 will now be described. A rechargeable electric battery 32 is connected by operation of operating button 5 through an electric switch 114 (see FIGS. 10–11) to an electric lighting means 28 in proximity to the gas emerging from the nozzle 3. The gas is turned on by the operation of the operating button 5 as previously described. The electric lighting means 28 may be a high-voltage capacitor 30 discharge type, shown schematically in FIG. 10, or a resistance-heater type, shown schematically in FIG. 11. An inner coil spring 36 is fitted inside the nozzle tip 7, and an outer coil spring 35 is fitted outside the nozzle tip 7. Both coil springs 35, 36 project beyond the end of the nozzle tip 7 thus creating an annular space between them in which outward flowing gas and inward flowing air become mixed to promote combustion.

Figure 9:
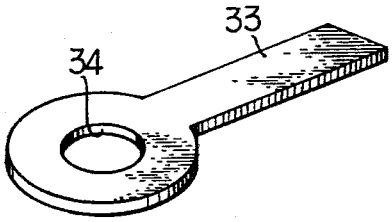
FIG. 9 shows a perspective view of a thermoconductive plate employed in the lighter of FIG. 8.

A thermoconductive plate 33, shown in detail in FIG. 9, is located in the upper end of the case 1 but thermally isolated therefrom. A flame hole 34 in the thermoconductive plate 34 is aligned with the flame hole 4 in the case 1. The flame hole 34 has a smaller diameter than the flame hole 4. A plurality of dissimilar thermocouple wires *26a, 27a* having junctions $b_1, b_2 \ldots b_n$ in thermal contact with the thermoconductive plate 33, are each electrically insulated from the thermoconductive plate 33. The cold junctions $c_1, c_2 \ldots c_n$ of the thermocouple pairs are thermally connected to and electrically insulated from a heat sink 134. The thermocouples are connected in series between terminals $a_1$ and $a_2$ of rechargeable electric battery 32. The heat sink 134 may be thermally connected to a thermal mass such as the rechargeable electric battery 32.

Figure 8:
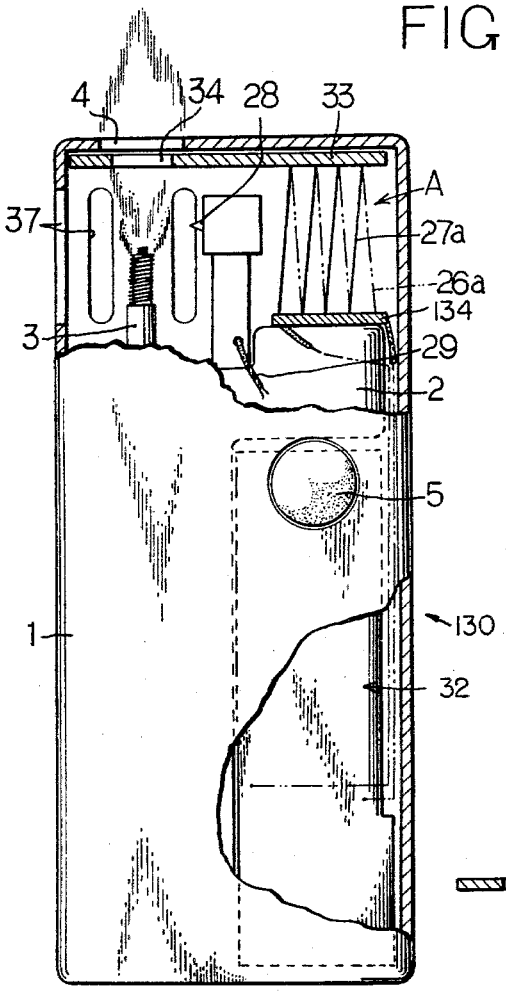
FIG. 8 shows a side elevation, partially in section of a third embodiment of the invention.

In operation, the operating button 5 in FIG. 8 turns on both the gas flow and the electric lighting means 28. The gas is ignited by either the spark discharge or heated filament powered by the rechargeable electric battery 32. The flame passing through flame hole 34 heats thermoconductive plate 34. The thermoconductive plate 33 distributes the heat substantially uniformly to thermocouple junctions $b_1, b_2 \ldots b_n$. The thermocouple junctions each thereupon generate a voltage. The voltages of all the junctions are added by series connection to produce a composite voltage at terminals $a_1$ and $a_2$ of the rechargeable electric battery 32. While thermoconductive plate 33 remains at a substantially higher temperature than heat sink 134, the recharging of rechargeable electric battery 32 continues. Suitable means well known in the art thus not shown are provided at the input of rechargeable electric battery 32 to prevent discharge of the battery through the series-connected thermocouple wires *26a, 27a* between its terminals.

Figure 12:
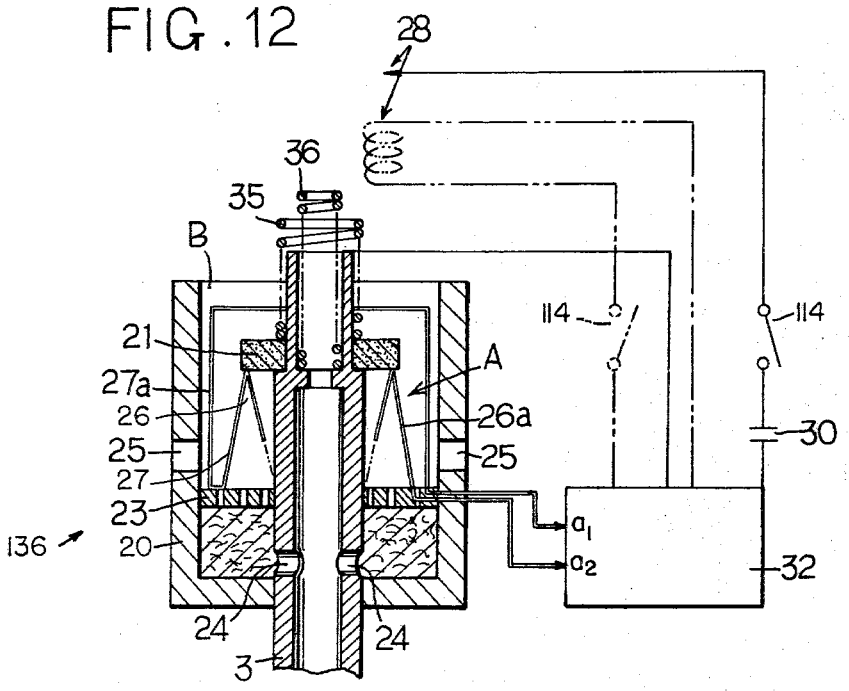
FIG. 12 shows a partially sectional and partially schematic diagram of a fourth embodiment of the invention.

A fourth embodiment of the invention is shown in FIG. 12 at 136. A rechargeable electric battery 32 is employed to energize an electric lighting means 28 of the discharge type shown in solid lines or alternatively of the resistance heater type shown in dot-dash lines (in a manner analogous to that shown in FIGS. 8–11). This embodiment has a thermal reaction body 20 quite similar to the thermal reaction body 20 shown in FIGS. 6 and 7, except that the thermocouple wires 26, 27 are electrically insulated from both the body of catalyst material 21 and from the foraminous plate 23. In addition, the thermocouples are connected electrically in series and the series voltage is connected to terminals $a_1$ and $a_2$ of rechargeable electric battery 32. In this embodiment, the difference between the temperature of the body of catalyst material 21 heated by the gas sample reaching it from transverse openings 24 and the temperature of the foraminous plate 23 is utilized to generate the recharging voltage.

It will be understood that the claims are intended to cover all changes and modifications of the preferred embodiments of the invention, herein chosen for the purpose of illustration which do not constitute departures from the spirit and scope of the invention.

What is claimed is:

1. In a cigarette lighter of the type wherein a flame is obtained by drawing a fuel gas over a catalyst, the improvement comprising:

(a) a nozzle stem;
(b) a heating element within said nozzle stem;
(c) said nozzle stem consisting of two cylindrical fitted members of a heat-resisting and insulating material whereby said nozzle stem can be separated at substantially the intermediate portion thereof;
(d) a nozzle tip fitted into the upper-end portion of said nozzle stem;
(e) a fuel tube fitted into the lower end portion of said nozzle stem;
(f) said catalyst is disposed in said nozzle stem, said catalyst being adapted to receive heated fuel gas from said heating element;
(g) a lever having two ends;
(h) one end of said lever secured at one end portion of said nozzle stem, movement of said lever adapted to move said nozzle stem and enable the ejecting of said fuel;
(i) a control button slidingly affixed to an outer surface of a sidewall of said cigarette lighter;
(j) the other end of said lever is attached to said control button;
(k) a power switch for controlling said heating element; and
(l) a power switch actuator operatively connected to said control button, said power switch actuator being adapted to close said power switch whereby said heating element commences heating.

2. The lighter of claim 1 further comprising a battery and means for electrically connecting said battery to said heating element, said heating element being a resistance heating element.

3. The lighter of claim 1 further comprising a metal net between said nozzle stem and said nozzle tip.

4. A cigarette lighter according to claim 1 wherein said heating element is wrapped within said catalyst whereby the catalyst directly receives the heat from said heating element.

5. The cigarette lighter of claim 1 further comprising a catalyst-holding cylinder adapted to receive the heated fuel-gas mixture from said heating element.

* * * * *